US010760028B2

(12) United States Patent
Uwano et al.

(10) Patent No.: US 10,760,028 B2
(45) Date of Patent: Sep. 1, 2020

(54) OIL TEMPERED WIRES

(71) Applicant: Sumitomo (SEI) Steel Wire Corp., Itami-shi (JP)

(72) Inventors: Takafumi Uwano, Itami (JP); Sadamu Matsumoto, Itami (JP); Takayuki Shiwaku, Itami (JP)

(73) Assignee: Sumitomo Electric Industries, Ltd., Osaka-shi (JP)

( * ) Notice: Subject to any disclaimer, the term of this patent is extended or adjusted under 35 U.S.C. 154(b) by 101 days.

(21) Appl. No.: 16/078,698

(22) PCT Filed: Jan. 24, 2017

(86) PCT No.: PCT/JP2017/002225
§ 371 (c)(1),
(2) Date: Aug. 22, 2018

(87) PCT Pub. No.: WO2017/163578
PCT Pub. Date: Sep. 28, 2017

(65) Prior Publication Data

US 2019/0055490 A1 Feb. 21, 2019

(30) Foreign Application Priority Data

Mar. 22, 2016 (JP) ..... 2016-057418

(51) Int. Cl.
*C10M 107/44* (2006.01)
*C23C 8/14* (2006.01)
(Continued)

(52) U.S. Cl.
CPC ..... *C10M 107/44* (2013.01); *C10M 107/28* (2013.01); *C10M 107/34* (2013.01);
(Continued)

(58) Field of Classification Search
CPC C10M 107/28; C10M 107/38; C10M 147/00; C10M 2213/062; C10M 107/34;
(Continued)

(56) References Cited

U.S. PATENT DOCUMENTS 6,589,324 B2 * 7/2003 Kamo ..... C23C 22/74 106/14.12
2003/0034170 A1 * 2/2003 Sugimaru ..... C23C 2/26 174/126.2
(Continued)

FOREIGN PATENT DOCUMENTS

JP H02-213417 A 8/1990
JP H05-269536 A 10/1993
(Continued)

*Primary Examiner* — Camie S Thompson
(74) *Attorney, Agent, or Firm* — Baker Botts L.L.P.; Michael A. Sartori

(57) ABSTRACT

An oil tempered wire includes a steel wire and a lubricant coating disposed around an outer circumference of the steel wire, wherein the lubricant coating includes a lubricant component resin and a binder resin, the lubricant component resin is at least one selected from polyacetals, polyimides, melamine resins, acrylic resins and fluororesins, the deposited mass of the lubricant coating is not less than 1.0 g/m2 and not more than 4.0 g/m2, and the surface roughness Rz of the steel wire is not more than 8.0 μm.

9 Claims, 1 Drawing Sheet

(51) Int. Cl.

| | |
|---|---|
| ***C21D 9/02*** | (2006.01) |
| ***C23C 8/80*** | (2006.01) |
| ***C21D 9/52*** | (2006.01) |
| ***C10M 107/28*** | (2006.01) |
| ***C10M 107/34*** | (2006.01) |
| ***C10M 107/38*** | (2006.01) |
| ***C23C 26/00*** | (2006.01) |
| ***C10N 40/32*** | (2006.01) |
| ***C10N 50/08*** | (2006.01) |

(52) U.S. Cl.

CPC ..... *C10M 107/38* (2013.01); *C21D 9/02* (2013.01); *C21D 9/525* (2013.01); *C23C 8/14* (2013.01); *C23C 8/80* (2013.01); *C23C 26/00* (2013.01); *C10M 2209/0845* (2013.01); *C10M 2209/1013* (2013.01); *C10M 2213/0623* (2013.01); *C10M 2217/0415* (2013.01); *C10M 2217/0425* (2013.01); *C10N 2040/32* (2013.01); *C10N 2050/08* (2013.01)

(58) Field of Classification Search

CPC ..... C10N 2240/50; C10N 2240/409; C10N 2240/408; C10N 2040/32; C21D 9/02; C21D 9/525; C23C 8/80; C23C 2/26; C23C 2/38; C23C 22/38; C23C 22/78; C23C 30/00; C23C 28/04; C23C 26/00; Y10T 29/49194; Y10T 428/24479; Y10T 428/31; F16F 1/02; F16F 1/04; F16F 2226/02; B23D 61/185

USPC ..... 428/375, 378, 379, 156, 409; 29/868; 508/181; 174/126.1

See application file for complete search history.

(56) References Cited

U.S. PATENT DOCUMENTS

| | | | |
|---|---|---|---|
| 2017/0137741 | A1 | 5/2017 | Hatakeyama et al. |
| 2017/0175021 | A1 | 6/2017 | Shiihashi et al. |

FOREIGN PATENT DOCUMENTS

| | | | |
|---|---|---|---|
| JP | H05-306479 | A | 11/1993 |
| JP | 07-188894 | A | 7/1995 |
| JP | H09-099517 | A | 4/1997 |
| JP | 2000-345268 | A | 12/2000 |
| JP | 2004-232058 | A | 8/2004 |
| JP | 2006-281315 | A | 10/2006 |
| WO | 2015146818 | A1 | 10/2015 |
| WO | 2015146848 | A1 | 10/2015 |

* cited by examiner

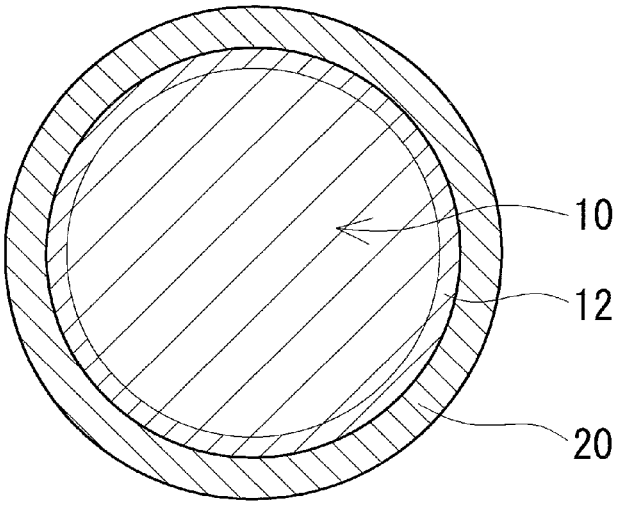
10
12
20

OIL TEMPERED WIRES

TECHNICAL FIELD

The present invention relates to oil tempered wires. This application claims priority to Japanese Patent Application No. 2016-057418, filed Mar. 22, 2016, which is herein incorporated by reference in its entirety.

BACKGROUND ART

From the point of view of controlling variations in spring shape, Patent Literatures 1 to 3 disclose oil tempered wires which have a lubricant coating of an amino acid compound on the surface of the steel wires for the purpose of enhancing surface lubrication of the wires.

CITATION LIST

Patent Literature

PTL 1: Japanese Unexamined Patent Application Publication No. 5-269536

PTL 2: Japanese Unexamined Patent Application Publication No. 5-306479

PTL 3: Japanese Unexamined Patent Application Publication No. 7-188894

SUMMARY OF INVENTION

An oil tempered wire according to one aspect of the present invention includes: a steel wire and a lubricant coating disposed around an outer circumference of the steel wire, wherein the lubricant coating includes a lubricant component resin and a binder resin, the lubricant component resin is at least one selected from polyacetals, polyimides, melamine resins, acrylic resins and fluororesins, the deposited mass of the lubricant coating is not less than 1.0 g/m$^2$ and not more than 4.0 g/m$^2$, and the surface roughness Rz of the steel wire is not more than 8.0 μm.

BRIEF DESCRIPTION OF DRAWING

FIG. 1 is a schematic sectional view illustrating a typical example of the configuration of an oil tempered wire according to an embodiment.

DESCRIPTION OF EMBODIMENTS

Oil tempered wires are used as spring steel wires to make, for example, valve springs used in automobile engines. In general, oil tempered wires are manufactured by hardening and tempering drawn wires of steel such as silicon chromium steel. Springs are made by winding (coiling) oil tempered wires. To enhance spring characteristics such as fatigue resistance and elastic loss resistance, the winding process is usually followed by heat treatments such as stress relieving annealing and nitriding.

The winding of oil tempered wires involves a coiling machine. In the winding process, the winding tool and the oil tempered wire can be jammed if the friction coefficient between them is high, with the result that the coiling speed becomes nonuniform and variations arise in the shapes (such as free length and coil diameter) of the spring that is obtained. An approach to this problem is to apply a lubricating oil to the wire surface in order to reduce the friction coefficient and to ensure lubrication between the winding tool and the oil tempered wire.

The variations in spring shape tend to be more significant as the coiling speed during the winding process is raised and the steel wires that form oil tempered wires are increased in strength. Thus, there has been a strong demand for the development of oil tempered wires which have enhanced lubrication on the surface of the oil tempered wires and exhibit superior coilability.

The present invention has been made in light of the circumstances discussed above. It is therefore an object of the present invention to provide oil tempered wires having superior coilability.

Solution to Problem

An oil tempered wire according to one aspect of the present invention includes:

a steel wire and a lubricant coating disposed around an outer circumference of the steel wire, wherein the lubricant coating includes a lubricant component resin and a binder resin, the lubricant component resin is at least one selected from polyacetals, polyimides, melamine resins, acrylic resins and fluororesins, the deposited mass of the lubricant coating is not less than 1.0 g/m$^2$ and not more than 4.0 g/m$^2$, and the surface roughness Rz of the steel wire is not more than 8.0 μm.

Advantageous Effects of Invention

The above oil tempered wire according to one aspect of the present invention has superior coilability.

Embodiments of Invention

First, a list of embodiments of the present invention will be described.

(1) An oil tempered wire according to one aspect of the present invention includes:

a steel wire and a lubricant coating disposed around an outer circumference of the steel wire, wherein the lubricant coating includes a lubricant component resin and a binder resin, the lubricant component resin is at least one selected from polyacetals, polyimides, melamine resins, acrylic resins and fluororesins, the deposited mass of the lubricant coating is not less than 1.0 g/m$^2$ and not more than 4.0 g/m$^2$, and the surface roughness Rz of the steel wire is not more than 8.0 μm.

The oil tempered wire has a lubricant coating on the surface of the steel wire which includes a lubricant component resin and a binder resin. An enhanced lubrication on the surface of the oil tempered wire can be provided by the lubricant coating which includes as the lubricant component resin at least one resin selected from polyacetals, polyimides, melamine resins, acrylic resins and fluororesins. The lubricant coating attains an enhanced adhesion with respect to the steel wire surface and can resist separation as a result of the incorporation of the binder resin in the lubricant coating. Further, a lubrication between the winding tool and the oil tempered wire during the winding process can be ensured by the lubricant coating deposited in a mass of not less than 1.0 g/m$^2$. The oil tempered wire can be prevented from excessive slippage on the winding tool and can be wound in a stably lubricated manner by virtue of the deposited mass of the lubricant coating being not more than 4.0 g/m$^2$. The oil tempered wire can attain a reduced friction coefficient with respect to the winding tool and thus can exhibit improved coilability during the winding process.

Further, the oil tempered wire can attain a reduced friction coefficient with respect to the winding tool by virtue of the surface roughness Rz of the steel wire being not more than 8.0 μm. The lower limit of the surface roughness Rz of the steel wire is not particularly limited, but may be, for example, 3.0 μm or above. When the surface roughness Rz of the steel wire is 3.0 μm or above, the adhesion between the steel wire surface and the lubricant coating is enhanced. Here, the "surface roughness Rz" means the maximum height (Rz) specified in JIS B 0601: 2001.

As discussed above, the oil tempered wire attains superior coilability and can be coiled while reducing variations in spring shape.

(2) In an embodiment of the oil tempered wire, the deposited mass of the lubricant component resin may be not less than 0.3 g/m$^2$ and not more than 3.0 g/m$^2$.

The lubricant component resin imparts lubricating properties mainly to the surface of the oil tempered wire and thereby contributes to an enhancement in lubrication. A sufficient lubrication between the winding tool and the oil tempered wire can be ensured when the deposited mass of the lubricant component resin is not less than 0.3 g/m$^2$. The oil tempered wire can be prevented from excessive slippage on the winding tool and can be wound in a stably lubricated manner when the deposited mass of the lubricant component resin is not more than 3.0 g/m$^2$. The oil tempered wire of this embodiment attains still improved coilability and the variations in spring shape can be reduced effectively.

(3) In an embodiment of the oil tempered wire, the lubricant coating may be one which disappears when heated at 400° C. for 20 minutes.

As described above, heat treatments such as stress relieving annealing and nitriding are performed after the winding process. The heat treatments generally take place, for example, at about 400° C. to 500° C. for approximately 20 minutes to 60 minutes, specifically at 420° C. to 480° C. for 20 minutes to 30 minutes, although variable depending on the type of steel of the steel wires. The lubricant coating which remains on the wire surface after the winding process can adversely affect the spring characteristics and can come off during the use of the spring to cause troubles.

In the oil tempered wire described above, the lubricant coating is thermally decomposed and disappears when it is heated at 400° C. for 20 minutes. Thus, adverse effects caused by the lubricant coating during use of the spring can be avoided. The term "disappear" is not limited to substantially perfect nonexistence of the lubricant coating or residues thereof, but also comprehends that residues (such as carbon) of the lubricant coating may remain within limits not detrimental to the characteristics of the oil tempered wire (for example, spring characteristics after the winding process).

(4) In an embodiment of the oil tempered wire, an oxide film may be disposed on the surface of the steel wire.

When an oxide film is disposed on the surface of the steel wire, the oil tempered wire can attain still enhanced lubricating properties and exhibits higher coilability. For example, the thickness of the oxide film may be not less than 2.0 μm and not more than 20 nm, and the amount of the oxide film may be not less than 3.0 g/m$^2$ and not more than 20 g/m$^2$. The lubricating properties are effectively enhanced when the thickness of the oxide film is 2.0 μm or more (the amount thereof is 3.0 g/m$^2$ or more). If the thickness of the oxide film is too large, the oxide film tends to be cracked and separated easily during the winding process, or the thickness of the oxide film tends to be nonuniform and the surface roughness Rz of the steel wire tends to be increased. The separation of the oxide film can be prevented and a small surface roughness Rz of the steel wire can be obtained when the thickness of the oxide film is 20 μm or less (the amount thereof is 20 g/m$^2$ or less).

(5) In an embodiment of the oil tempered wire, an outer circumference of the lubricant coating may be coated with a lubricating oil.

The coating of a lubricating oil on the outer circumference of the lubricant coating can make up for a failure of lubrication between the winding tool and the oil tempered wire so as to provide improved coilability, and can be also expected to prevent the steel wire from rusting.

Details of Embodiments of Invention

Specific examples of the oil tempered wires according to embodiments of the present invention will be described below. Such examples do not limit the scope of the present invention, and the present invention is defined by the claims and intends to include equivalents to what is claimed and all modifications that fall within the scope of the invention claimed.

<Oil Tempered Wires>

The configurations of an oil tempered wire according to an embodiment will be described with reference to FIG. 1. FIG. 1 is a cross sectional view of an oil tempered wire cut in a direction perpendicular to the axial direction. As illustrated in FIG. 1, the oil tempered wire includes a steel wire 10, and a lubricant coating 20 disposed on the surface of the steel wire 10. One of the characteristics of the oil tempered wire of the present embodiment is that the lubricant coating 20 includes a lubricant component resin and a binder resin, and the lubricant component resin is at least one resin selected from polyacetals, polyimides, melamine resins, acrylic resins and fluororesins. The configurations of the oil tempered wire will be described in detail below.

(Steel Wires)

The steel wire 10 that constitutes the oil tempered wire may be a known steel wire. Examples of the types of steels for the steel wires include carbon steel (SWO-V), silicon chromium steel (SWOSC-V), chromium vanadium steel (SWOCV-V) and silicon manganese steel (SWOSM). Use may be made of steel wires which are based on the above steels and contain cobalt and vanadium. The steel wire 10 may be made by a known production method, for example, by hardening and tempering treatments of a drawn steel such as silicon chromium steel. The conditions for the manufacture up to the hardening and tempering treatments may be conventional.

<Surface Roughness>

The surface roughness Rz of the steel wire 10 is not more than 8.0 μm. As a result of the surface roughness Rz of the steel wire 10 being not more than 8.0 μm, the oil tempered wire can be coiled with a small friction coefficient between the winding tool and the oil tempered wire. The surface roughness Rz of the steel wire 10 can be controlled to not more than 8.0 μm by passing the steel wire 10 repeatedly through a drawing die. The surface roughness Rz may be further reduced by polishing the surface of the steel wire 10 that has been drawn. For production reasons, the lower limit of the surface roughness Rz of the steel wire 10 is preferably 3.0 μm or above. When the surface roughness Rz of the steel wire 10 is 3.0 μm or above, the adhesion between the steel wire 10 and the lubricant coating 20 is enhanced. When the surface roughness Rz of the steel wire 10 is not more than 8.0 μm, the steel wire 10 does not need to be surface-polished after its drawing and thus high productivity is obtained. The surface roughness Rz of the steel wire 10 is determined by measuring the surface roughness Rz of the steel wire 10 with a surface roughness meter with respect to a plurality of regions that are aligned in the circumferential direction at the same location in the axial direction, the results being averaged. The measurement takes place on at least eight or more regions. In the case where the steel wire has an oxide film on the surface, the surface roughness Rz discussed here is the same as the surface roughness Rz of the oxide film. When there is no oxide film, the surface roughness Rz is that of the steel wire itself (Lubricant Coatings)

The lubricant coating 20 is disposed on the outer circumference of the steel wire 10, and includes a lubricant component resin and a binder resin. The lubricant coating 20 is principally composed of the lubricant component resin. Here, the term "principally" means that the component has the largest mass proportion of all the components present in the lubricant coating 20.

<Lubricant Component Resins>

The lubricant component resin imparts lubricating properties mainly to the surface of the oil tempered wire and thereby contributes to an enhancement in lubrication. The lubricant component resin may be at least one resin selected from polyacetals, polyimides, melamine resins, acrylic resins and fluororesins. Examples of the fluororesins include polychlorotrifluoroethylene (PCTFE) and polytetrafluoroethylene (PTFE). For example, the content of the lubricant component resin is not less than 30 mass % and not more than 75 mass %, and is preferably not less than 33 mass % and not more than 65 mass %.

<Binder Resins>

The binder resin functions as a binder for the lubricant component resin, and contributes to an enhancement in adhesion of the lubricant coating. Examples of the binder resins include acrylic resins. An acrylic resin can serve as both the lubricant component resin and the binder resin. For example, the content of the binder resin is not less than 12.5 mass % and not more than 35 mass %, and preferably not less than 16 mass % and not more than 33 mass %.

(Other Components)

In addition to the lubricant component resin and the binder resin, the lubricant coating 20 may contain a proportion of other components such as a preservative. Examples of the preservatives include boric acid and monoethanolamine.

<Methods for Forming Lubricant Coatings>

The lubricant coating 20 is formed by applying a coating material including the lubricant component resin and the binder resin onto the outer circumference of the steel wire 10. For example, the lubricant coating 20 may be formed by dispersing the lubricant component resin and the binder resin into water to give a coating liquid as the coating material, and applying the coating liquid onto the outer circumference of the steel wire 10 followed by drying. Some example methods for the application are a soaking method in which the steel wire 10 is soaked into the coating liquid, and a spraying method in which the coating liquid is sprayed to the outer circumference of the steel wire 10.

<Deposited Mass of Lubricant Coating>

The deposited mass of the lubricant coating 20 is not less than 1.0 g/m$^2$ and not more than 4.0 g/m$^2$. The lubricant coating deposited in a mass of not less than 1.0 g/m$^2$ can ensure a lubrication between the winding tool and the oil tempered wire during the winding process. Limiting the deposited mass of the lubricant coating to not more than 4.0 g/m$^2$ can prevent the excessive slippage of the oil tempered wire on the winding tool and thus can provide a stable lubrication. The deposited mass of the lubricant coating 20 may be controlled by controlling the amount in which the coating material (the coating liquid) is applied. For example, the deposited mass of the lubricant coating 20 may be increased by repeating the application of the coating liquid onto the outer circumference of the steel wire 10. For example, the deposited mass of the lubricant coating is preferably not less than 1.0 g/m$^2$ and less than 3.0 g/m$^2$, and is more preferably not less than 1.5 g/m$^2$ and not more than 2.5 g/m$^2$.

For example, the deposited mass of the lubricant coating 20 may be determined in the following manner. The mass of the oil tempered wire having the lubricant coating 20 is measured. The lubricant coating 20 is then dissolved with a solvent, and the mass of the oil tempered wire cleaned of the lubricant coating is measured. The difference in mass before and after the removal of the lubricant coating 20 is determined. The difference in mass thus determined is divided by the surface area of the steel wire 10 to yield the deposited mass of the lubricant coating 20 per unit area of the surface of the steel wire 10.

<Deposited Mass of Lubricant Component Resin>

The deposited mass of the lubricant component resin present in the lubricant coating 20 is preferably not less than 0.3 g/m$^2$ and not more than 3.0 g/m$^2$. The lubricant component resin deposited in a mass of not less than 0.3 g/m$^2$ can ensure a sufficient lubrication between the winding tool and the oil tempered wire. Limiting the deposited mass of the lubricant component resin to not more than 3.0 g/m$^2$ can prevent the excessive slippage of the oil tempered wire on the winding tool and thus can provide a stable lubrication. For example, the deposited mass of the lubricant component resin is preferably not less than 0.3 g/m$^2$ and less than 2.25 g/m$^2$, and is more preferably not less than 0.45 g/m$^2$ and not more than 1.875 g/m$^2$.

For example, the deposited mass of the lubricant component resin may be determined in the following manner. With use of a matrix assisted laser desorption/ionization time of flight mass spectrometer (MALDI-TOFMS), the mass proportion of the lubricant component resin contained in the lubricant coating 20 is determined. The deposited mass of the lubricant component resin may be calculated based on the mass proportion thus obtained. The deposited mass of the binder resin may be similarly determined based on the mass proportion of the binder resin present in the lubricant coating 20.

<Thermal Decomposability of Lubricant Coating>

The lubricant coating 20 is preferably one which disappears when heated at 400° C. for 20 minutes. This configuration allows the lubricant coating 20 to disappear during heat treatments such as stress relieving annealing and nitriding which are performed after the winding of the oil tempered wire, thus making it possible to avoid adverse effects by the lubricant coating 20 during use of the oil tempered wire as a spring. Such a lubricant coating 20 may be obtained by forming the lubricant coating 20 using a material which is thermally decomposed at 400° C. or above. For example, polyacetals, melamine resins and acrylic resins used as the lubricant component resins are thermally decomposed at 400° C. and above.

(Oxide Films)

As illustrated in FIG. 1, the oil tempered wire may have an oxide film 12 disposed on the surface of the steel wire 10. When an oxide film 12 is disposed on the surface of the steel wire 10, the lubricating properties on the surface of the oil tempered wire can be further enhanced. For example, the thickness of the oxide film 12 may be not less than 2.0 μm and not more than 20 μm, and the amount of the oxide film 12 may be not less than 3.0 g/m$^2$ and not more than 20 g/m$^2$. The lubricating properties are effectively enhanced when the thickness of the oxide film 12 is 2.0 μam or more. If the thickness of the oxide film 12 is too large, the oxide film 12 tends to be cracked and separated easily during the winding process, or the thickness of the oxide film 12 tends to be nonuniform and the surface roughness Rz of the steel wire 10 tends to be increased. The separation of the oxide film 12 can be prevented and a small surface roughness Rz of the steel wire 10 can be obtained when the thickness of the oxide film 12 is 20 μm or less. For example, the thickness of the oxide film 12 is preferably not less than 2.0 μm and not more than 10 μm.

The oxide film 12 is formed mainly during the hardening/tempering of the steel wire 10. Specifically, the oxide film arises from the oxidation of the surface of the steel wire 10 by reaction with oxygen in the atmosphere when the steel wire 10 is hardened by heating or when the steel wire 10, after being hardened, is tempered by heating. The thickness of the oxide film 12 can be controlled by adjusting the conditions for the heating during the hardening/tempering. For example, the thickness of the oxide film 12 can be controlled by controlling the oxygen concentration in the atmosphere, the heating temperature or the heating time. Increasing the oxygen concentration, the heating temperature or the heating time tends to make the oxide film 12 thicker. The heating atmosphere during the hardening/tempering may be an oxidizing atmosphere such as atmospheric air. For example, the heating for hardening may take place at a temperature of not less than 900° C. and not more than 1050° C. for a heating time of not less than 10 seconds and not more than 180 seconds. For example, the heating for tempering may take place at a temperature of not less than 400° C. and not more than 600° C. for a heating time of not less than 30 seconds and not more than 200 seconds.

The thickness of the oxide film 12 may be determined by observing with an optical microscope a cross section of the oil tempered wire (the steel wire 10) cut in a direction perpendicular to the axial direction, and actually measuring the thickness with respect to the cross sectional image. Here, the thickness of the oxide film 12 is measured with respect to a plurality of regions along the circumference of the steel wire 10, the results being averaged.

The measurement takes place on at least eight or more regions.

(Lubricating Oils)

The surface of the lubricant coating 20 may be coated with a lubricating oil (not shown). The coating of a lubricating oil on the surface of the lubricant coating can make up for a failure of lubrication between the winding tool and the oil tempered wire so as to provide improved coilability, and can be also expected to prevent the steel wire from rusting. Examples of the lubricating oils include gear oils, mineral oils and plant oils.

TEST EXAMPLE 1

Silicon chromium steel (SWOSC-V) was drawn to a steel wire having a wire diameter of 3.0 mm. The steel wire was hardened and tempered. An oil tempered wire was thus manufactured. The hardening was performed by heating in an inert gas atmosphere at 1020° C. for 60 seconds, and the tempering was carried out by heating in air at 500° C. for 100 seconds.

The hardened and tempered steel wire was analyzed to determine the surface roughness Rz and the thickness of the oxide film. The surface roughness Rz of the steel wire was measured in accordance with JIS B 0601 with a surface roughness meter (SURFTEST SV-2100 manufactured by Mitutoyo Corporation) over a reference length along the direction of the axis of the steel wire. Here, the surface roughness was measured with respect to eight regions which had been equally divided along the direction of the circumference of the steel wire, the results being averaged. The thickness of the oxide film was determined by actual observation of a cross section of the steel wire on an optical microscope. Here, the thickness was measured with respect to eight regions which had been equally divided along the direction of the circumference of the steel wire, the results being averaged. Consequently, the surface roughness Rz of the steel wire was measured to be 6 μm and the thickness of the oxide film 4 μm.

Next, a lubricant coating was formed on the outer circumference of the hardened and tempered steel wire. Specifically, a lubricant component resin, a binder resin and preservatives were mixed and dispersed into water to give a coating liquid, which was then applied onto the surface of the steel wire, and the wet film was allowed to dry naturally to form a lubricant coating. Here, the lubricant component resin was a melamine resin, the binder resin was an acrylic resin, and the preservatives were boric acid and monoethanolamine. These were used in proportions of 40 mass % for the melamine resin, 23 mass % for the binder resin, and the balance for the preservatives. The coating liquid was applied so that the deposited mass of the lubricant coating would be 2.1 g/m$^2$ (the deposited mass of the lubricant component resin would be 0.84 g/m$^2$).

In the manner described above, the oil tempered wire was given a lubricant coating on the surface of the steel wire. This oil tempered wire is sample No. 1-1. Oil tempered wire sample No. 1-1 was subjected to the following evaluations.

(Thermal Decomposability of Lubricant Coating)

Oil tempered wire sample No. 1-1 was heated at 400° C. for 20 minutes to evaluate the thermal decomposability of the lubricant coating. As a result, the lubricant coating was thermally decomposed and disappeared.

(Coilability)

Oil tempered wire sample No. 1-1 was coiled with a coiling machine and its coilability was evaluated. Here, 10000 springs were manufactured which had a free length of 60.0 mm, an average spring diameter of 18.0 mm and a total number of coils of 8.5. The variations in free length of the springs (average and standard deviation) were determined. The results are described in Table 1.

For comparison, the same steel wire as oil tempered wire sample No. 1-1 was provided, and a lubricating oil was applied to the outer circumference of the steel wire. Oil tempered wire sample No. 1-2 was thus manufactured. The coilability of oil tempered wire sample No. 1-2 was evaluated in the same manner as for sample No. 1-1. The results are described in Table 1.

TABLE 1

| Sample No. | Average free length (mm) | Standard deviation |
|---|---|---|
| 1-1 | 60.2 | 0.063 |
| 1-2 | 60.9 | 0.134 |

From the results shown in Table 1, the average free length of the springs of oil tempered wire sample No. 1-1 satisfied 60.0±0.5 mm and the standard deviation was not more than 0.100. It has been thus demonstrated that the springs had small variations in free length and the coilability was excellent as compared to sample No. 1-2.

TEST EXAMPLE 2

Oil tempered wire samples Nos. 2-1 to 2-8 described in Table 2 were manufactured in the same manner as for oil tempered wire sample No. 1-1 in TEST EXAMPLE 1, except that the deposited mass of the lubricant coating was changed. The coilability of oil tempered wire samples Nos. 2-1 to 2-8 was evaluated in the same manner as for sample No. 1-1. The results are described in Table 2. In Table 2, the deposited masses of the lubricant component resin are values calculated based on the mass proportion of the lubricant component resin in the lubricant coating.

TABLE 2

| Sample No. | Deposited mass of lubricant coating ($g/m^2$) | Deposited mass of lubricant component resin ($g/m^2$) | Average free length (mm) | Standard deviation |
|---|---|---|---|---|
| 2-1 | 0.5 | 0.2 | 60.8 | 0.131 |
| 2-2 | 1.0 | 0.4 | 59.9 | 0.081 |
| 2-3 | 1.5 | 0.6 | 60.4 | 0.065 |
| 2-4 | 2.0 | 0.8 | 60.1 | 0.070 |
| 2-5 | 2.5 | 1.0 | 60.1 | 0.072 |
| 2-6 | 3.0 | 1.2 | 59.8 | 0.084 |
| 2-7 | 4.0 | 1.6 | 60.5 | 0.088 |
| 2-8 | 4.5 | 1.8 | 60.7 | 0.122 |

From the results shown in Table 2, samples Nos. 2-2 to 2-6 having a deposited mass of the lubricant coating in the range of 1.0 $g/m^2$ to 4.0 $g/m^2$ have been demonstrated to have small variations in free length of the springs and have superior coilability as compared to samples Nos. 2-1 and 2-8 which failed to satisfy the above range. It is probable that the lubricating properties on the surface of the oil tempered wire were enhanced and a stable lubrication was obtained by virtue of the deposited mass of the lubricant coating being 1.0 $g/m^2$ to 4.0 $g/m^2$.

In contrast, sample No. 2-1 showed low coilability probably because the deposited mass of the lubricant coating was small and consequently a sufficient enhancement in lubricating properties was not obtained. Sample No. 2-8 was poor in coilability probably because the deposited mass of the lubricant coating was so large that a stable lubrication was not exhibited and the wire excessively slipped more than necessary during the coiling process.

TEST EXAMPLE 3

Oil tempered wire samples were manufactured in the same manner as for oil tempered wire sample No. 1-1 in TEST EXAMPLE 1, except that the lubricant component resin was changed from melamine resin to polyacetal, polyimide, acrylic resin and fluororesin (PTFE).

The coilability of these samples was evaluated in the same manner as for sample No. 1-1. Each of the samples was demonstrated to have small variations in free length of the springs and to have sufficient coilability, with the average free length of the springs satisfying 60.0±0.5 mm and the standard deviation being not more than 0.100.

REFERENCE SIGNS LIST

10 STEEL WIRE
12 OXIDE FILM
20 LUBRICANT COATING

The invention claimed is:

1. An oil tempered wire comprising a steel wire and a lubricant coating disposed around an outer circumference of the steel wire, wherein the lubricant coating includes a lubricant component resin and a binder resin, the lubricant component resin is at least one selected from polyacetals, polyimides, melamine resins and acrylic resins, the deposited mass of the lubricant coating is not less than 1.0 $g/m^2$ and not more than 4.0 $g/m^2$, and the surface roughness Rz of the steel wire is not more than 8.0 μm.

2. The oil tempered wire according to claim 1, wherein the deposited mass of the lubricant component resin is not less than 0.3 $g/m^2$ and not more than 3.0 $g/m^2$.

3. The oil tempered wire according to claim 1, wherein the lubricant coating disappears when heated at 400° C. for 20 minutes.

4. The oil tempered wire according to claim 1, wherein an oxide film is disposed on the surface of the steel wire.

5. The oil tempered wire according to claim 1, wherein an outer circumference of the lubricant coating is coated with a lubricating oil.

6. The oil tempered wire according to claim 1, wherein the lubricant component resin is polyacetals.

7. The oil tempered wire according to claim 1, wherein the lubricant component resin is polyimides.

8. The oil tempered wire according to claim 1, wherein the lubricant component resin is melamine resins.

9. The oil tempered wire according to claim 1, wherein the lubricant component resin is acrylic resins.

* * * * *